US012808278B2

(12) United States Patent
Jandhyala et al.

(10) Patent No.: US 12,808,278 B2
(45) Date of Patent: Nov. 24, 2026

(54) HYBRID APPROACH TO TAILOR DESIGN CHOICES FOR IMPROVED RISK MITIGATION DURING CEMENT JOB DESIGN

(71) Applicant: Halliburton Energy Services, Inc., Houston, TX (US)

(72) Inventors: Siva Rama Krishna Jandhyala, Houston, TX (US); Kvvn Krishna Babu Yerubandi, Houston, TX (US); Walmy Cuello Jimenez, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 954 days.

(21) Appl. No.: 18/104,085

(22) Filed: Jan. 31, 2023

(65) Prior Publication Data

US 2024/0254857 A1 Aug. 1, 2024

(51) Int. Cl.
*E21B 33/14* (2006.01)
*E21B 47/06* (2012.01)

(52) U.S. Cl.
CPC ..... *E21B 33/14* (2013.01); *E21B 47/06* (2013.01)

(58) Field of Classification Search
CPC ..... E21B 33/14; E21B 47/06
See application file for complete search history.

(56) References Cited

U.S. PATENT DOCUMENTS 10,502,020 B2 12/2019 Gao et al.
10,890,046 B2 1/2021 Singh et al.
(Continued)

FOREIGN PATENT DOCUMENTS

CA 2858842 A1 7/2013
CN 114526053 A 5/2022

OTHER PUBLICATIONS

International Search Report and Written Opinion for International Patent Application No. PCT/US2023/076342 dated Feb. 6, 2024. PDF file. 7 pages.

(Continued)

*Primary Examiner* — Nithya J. Moll
(74) *Attorney, Agent, or Firm* — Thomas Rooney; C. Tumey Law Group, PLLC

(57) ABSTRACT

A method of designing a cement job may include: (a) selecting a cement job plan comprising: cement placement variables, wellbore construction variables, and subterranean formation properties; (b) calculating a predicted hydraulic pressure ($P_{hydraulic}$) of the cement job plan using a physics based hydraulic model; (c) calculating a pressure differential ($\Delta P$) of the cement job plan using a data driven hydraulic model; (d) calculating a predicted observed surface pressure ($P_{observed}$) from the pressure differential ($\Delta P$) and a predicted hydraulic pressure ($P_{hydraulic}$); (e) comparing the predicted observed surface pressure ($P_{observed}$) to a surface pressure requirement window, wherein steps (a)-(e) are repeated if the predicted observed surface pressure ($P_{observed}$) is within the surface pressure requirement window, wherein each repeated step of selecting comprises selecting at least one different cement placement variables than previously selected, or step (f) is performed if the if the predicted observed surface pressure ($P_{observed}$) is less than the surface pressure requirement; and (f) performing a cementing operation in a subterranean formation according to the cement job plan.

20 Claims, 3 Drawing Sheets

(56) References Cited

U.S. PATENT DOCUMENTS

| | | | | |
|---|---|---|---|---|
| 11,549,369 | B1 * | 1/2023 | LeBlanc | G01L 1/242 |
| 2013/0048380 | A1 * | 2/2013 | Rasmus | E21B 49/005 166/250.01 |
| 2013/0049983 | A1 * | 2/2013 | Rasmus | E21B 47/10 340/854.4 |
| 2013/0054146 | A1 * | 2/2013 | Rasmus | E21B 47/06 702/9 |
| 2013/0090855 | A1 * | 4/2013 | Rasmus | E21B 21/08 702/9 |
| 2015/0322775 | A1 | 11/2015 | Marland et al. | |
| 2016/0341031 | A1 | 11/2016 | Yerubandi et al. | |
| 2018/0045031 | A1 | 2/2018 | Shaposhnikov et al. | |
| 2018/0135365 | A1 | 5/2018 | Knudsen et al. | |
| 2018/0238139 | A1 | 8/2018 | Gao et al. | |
| 2018/0245427 | A1 | 8/2018 | Jimenez et al. | |
| 2018/0274327 | A1 | 9/2018 | Patil et al. | |
| 2018/0283165 | A1 | 10/2018 | Gao et al. | |
| 2018/0328127 | A1 | 11/2018 | Ravi et al. | |
| 2018/0363414 | A1 | 12/2018 | Bogaerts et al. | |
| 2019/0330942 | A1 * | 10/2019 | King | E21B 47/06 |
| 2021/0151133 | A1 | 5/2021 | Singh et al. | |
| 2021/0189874 | A1 * | 6/2021 | Jaaskelainen | E21B 47/135 |
| 2021/0238983 | A1 | 8/2021 | Singh et al. | |
| 2021/0238985 | A1 | 8/2021 | Yerubandi et al. | |
| 2021/0324704 | A1 | 10/2021 | Jandhyala | |
| 2021/0324847 | A1 | 10/2021 | Mattock et al. | |
| 2022/0009835 | A1 | 1/2022 | Jandhyala et al. | |
| 2022/0009844 | A1 | 1/2022 | Jandhyala et al. | |
| 2022/0009845 | A1 | 1/2022 | Jandhyala et al. | |
| 2022/0009846 | A1 | 1/2022 | Jandhyala et al. | |
| 2022/0009847 | A1 | 1/2022 | Singh et al. | |
| 2022/0010190 | A1 | 1/2022 | Singh et al. | |
| 2023/0037091 | A1 | 2/2023 | Jandhyala et al. | |
| 2023/0111521 | A1 | 4/2023 | Singh et al. | |

OTHER PUBLICATIONS

Australian Examination report No. 1 for AU Patent Application No. 2023427131 dated Sep. 3, 2026. PDF file. 4 pages.

* cited by examiner

HYBRID APPROACH TO TAILOR DESIGN CHOICES FOR IMPROVED RISK MITIGATION DURING CEMENT JOB DESIGN

BACKGROUND

In well cementing, such as well construction and remedial cementing, cement compositions are commonly utilized. Cement slurries may be used in a variety of subterranean applications. For example, in subterranean well construction, a pipe string (e.g., casing, liners, expandable tubulars, etc.) may be run into a well bore and cemented in place. The process of cementing the pipe string in place is commonly referred to as "primary cementing." In a typical primary cementing method, a cement slurry or a resin-based system may be pumped into an annulus between the walls of the well bore and the exterior surface of the pipe string disposed therein. The cement slurry or resin system may set in the annular space, thereby forming an annular sheath of hardened, substantially impermeable cement or resin (i.e., a cement sheath or annular sealant) that may support and position the pipe string in the well bore and may bond the exterior surface of the pipe string to the subterranean formation. Among other things, the cement sheath surrounding the pipe string functions to prevent the migration of fluids in the annulus, as well as protecting the pipe string from corrosion. Cement slurries also may be used in remedial cementing methods, for example, to seal cracks or holes in pipe strings or cement sheaths, to seal highly permeable formation zones or fractures, to place a cement plug, and the like.

Hydraulic simulators are utilized when designing wellbore cements to estimate surface pumping pressures. Hydraulic simulators take as input wellbore geometry, cement or resin composition, rheology of fluids pumped and existing prior to cementing operation, flow rate, density and volume of different fluids, presence of mechanical separators like plugs, darts etc., presence of managed pressure from surface, fluid physical properties, and loss circulation where applicable. To solve the set of equations that govern the flow process, hydraulic simulators use model assumptions related to annular pack off, intermixing among wellbore fluids, losses in the well, borehole shape, centering of casing in borehole, as well as other assumptions, and output a predicted surface pumping pressure. A hydraulic simulator is a physics-based approach which utilizes hydraulic models and mathematical equations to predict surface pumping pressures which can be utilized as a reference for the progress of a wellbore cementing operation as well as a means to assess risk of unwanted events occurring during the job. While hydraulic simulators can predict surface pressures accurately under certain conditions, it is possible that the actual surface pressure during pumping deviates from the predicted surface pumping pressure. There may be many reasons predicted surface pumping pressure deviates from actual surface pumping pressure including quality of model inputs, underlying model assumptions, operational deviations in well condition such as fluid losses, annular pack-off, pipe movement, level of exactness in representing the wellbore geometry, fluid properties and pumping variables, among others.

Predicted surface pumping pressure also represent a quantifiable operational risk to the wellbore cementing operation. The predicted surface pumping pressure is utilized to assess safety of the cementing operation to ensure that the pressure rating of surface, downhole formations and downhole equipment is not exceeded. It is also used to assess risk of fluid flow from the formation during and immediately after a cement job. Cement designs and equipment operation may be modified in response to the predicted surface pumping pressure such that the risk from pumping at excess or low pressure is mitigated.

While there are some contributing factors to surface pumping pressure which are universal in all cement wells, there are also contributing factors which are location, rig, and/or pad specific. The physics-based hydraulic simulators and the hydraulic models used thereby are unable to account for the location specific contributing factors to surface pumping pressure which results in a less accurate prediction of surface pumping pressure. There may be large differences in predicted and actual pumping pressures which poses a challenge to the use of hydraulic simulators as a reliable means to quantify risks.

BRIEF DESCRIPTION OF THE DRAWINGS

These drawings illustrate certain aspects of some of the embodiments of the present disclosure and should not be used to limit or define the disclosure.

DETAILED DESCRIPTION

The present disclosure may generally relate to cementing methods and systems. More particularly, embodiments may be directed to hybrid modeling methods for estimating surface pumping pressures in cementing operations. Further embodiments may be directed to tailoring cement designs and cement pumping operations using hybrid modeling methods. The hybrid hydraulic model of the present disclosure includes a combined data driven hydraulic model and physics-based hydraulic model. As discussed above, hydraulic simulators are well understood in wellbore cementing but because they are underpinned by physics-based hydraulic models, the physics-based hydraulic model alone may not be robust enough to accurately predict surface pumping pressure. Physics-based hydraulic models may include computational fluid dynamics (CFD) modeling techniques, for example. The data driven model complements the physics-based hydraulic model by modeling surface pumping pressure difference, i.e., the difference between measured value of surface pumping pressure and the value predicted by physics-based hydraulic model, as a function of factors which are specific to the wellbore and cementing job type.

The hybrid hydraulic model is more robust than the physics-based hydraulic model alone as the data driven model uses additional modeled factors to predict surface pumping pressure which results in a more accurate model of surface pumping pressure. There may be modeled factors in the data driven model which are significant factors for one location and job type while not significant for a different location and job type.

A hybrid hydraulic model approach also allows for programmatic identification of execution incidences involving annular pack-off, loss circulation, and wellbore geometry variations allowing for a wellbore specific contingency planning and risk mitigation. The hybrid approach combines the best of both worlds of universal scientific principles of fluid interactions and operational attributes such as geography and placement methodologies. The hybrid hydraulic model can be utilized to design a cementing job with higher probability of operational success which ultimately results in achieved top of cement and annular isolation.

Figure 1:
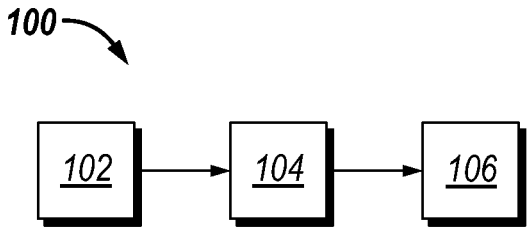
FIG. 1 illustrates a method to develop a data driven hydraulic model for use in a hybrid hydraulic model, in accordance with some embodiments of the present disclosure.

FIG. 1 illustrates a process 100 to build a data driven hydraulic model for use in a hybrid hydraulic model. Process 100 begins at block 102. In block 102, a dataset containing cementing job data is provided. The dataset may include, without limitation, planned cementing data for cementing jobs and the executed cementing data for the cementing jobs for wells across multiple geographies and cementing job types. Cementing job types may include, without limitation, cementing surface casings, cementing conductor casings, cementing intermediate casings, cementing production casings, and cementing production liners, for example. Planned cementing data for cementing jobs may include cement placement variables, including, without limitation, planned surface pumping pressures, planned pumping rates, planned cement composition, planned spacer composition, planned fluid volumes, planned fluid densities, for example. The planned cementing data may further include wellbore construction variables which may include, without limitation, presence of bottom plugs, well true vertical depth (TVD), well true measured depth (TMD), inclination, and standoff value, dog leg severity, for example. The planned cementing data may further include specifics about the subterranean formation properties, but not limited to, pore pressure, fracture gradient, bottomhole static temperature, wellbore temperature profile, and flow potential factor, for example. The executed cement data may include observed surface pumping pressures, observed rates, observed volumes, and observed fluid densities, observed wellbore characteristics and construction, observed fluid compositions pumped, observed volumes pumped, observed fluid densities, spacer contact time, volume excess, maximum equivalent circulating density (ECD), minimum hydrostatic pressure, maximum hydrostatic pressure, as well as equipment telemetry collected during cement placement such as observed temperatures from surface and downhole sensors, for example.

In block 104, plan data and executed data for cementing jobs of the same type with similar or same well conditions such as TMD (total measured depth), TVD (true vertical depth), BHCT (bottom hole circulating temperature), mud weight, casing and hole size, for example are parsed from the dataset from block 102. Planned surface pumping pressure and observed surface pumping pressure the parsed cementing data and executed cement data are compared to generate an observed pressure differential ΔP, which is the difference between observed and planned surface pumping pressure.

In block 106, a regression model is generated by modeling observed pressure differential ΔP from block 104 as a function of cement placement variables, including, but not limited to, differences in observed rate versus planned rate, observed volume versus planned volume, observed fluid densities versus planned fluid densities, and any other factors such as observed wellbore characteristics and construction, observed fluid compositions pumped, spacer contact time, cement and/or spacer volume, volume excess, difference between maximum equivalent circulating density and fracture gradient, difference between minimum hydrostatic pressure and pore pressure, maximum hydrostatic pressure, well true vertical depth, inclination, and standoff value, minimum density difference between two successive fluid trains, for example. Equation 1 is a generalized form of an equation for observed pressure differential ΔP. Equation 1 can have any suitable form including multilinear, parabolic, exponential, derivative, integral, hyperbolic, trigonometric, and combinations thereof. Alternately, Equation 1 can be a black box model such as an artificial neural network, convolutional neural network, recurrent neural network, decision tree, random forest, boosting, extreme gradient boosting, Gaussian process regression, spline regression, and multi-variate adaptive regression spline, for example. The generated regression model is the data driven hydraulic model which can be used to predict a difference in predicted pressure versus observed pressure as a function of cement placement variables, wellbore construction properties, and subterranean formation properties for each geographical region and cement job type.

Equation 2 is a generalized multilinear form of an equation for observed pressure differential ΔP where β is the slope coefficient for each factor from the dataset from block 102 included in the regression analysis. Equation 3 is an equation for pressure differential ΔP as a function of observed surface pressure ($P_{observed}$) and a predicted surface pressure from a physics based hydraulic model ($P_{hydraulic}$). Equations 2 and 3 can be combined to Equation 4 to solve for observed surface pressure ($P_{observed}$).

$$\Delta P = f(\text{placement variables, wellbore construction, formation properties}) \quad \text{Equation 1}$$

$$\Delta P = f(\beta_0 + \beta_1\text{Factor}_1 + \beta_2\text{Factor}_2 + \ldots + \beta_n\text{Factor}_n) \quad \text{Equation 2}$$

$$\Delta P = P_{observed} - P_{hydraulic} \quad \text{Equation 3}$$

$$P_{observed} = f(\beta_0 + \beta_1\text{Factor}_1 + \beta_2\text{Factor}_2 + \ldots + \beta_n\text{Factor}_n) + P_{hydraulic} \quad \text{Equation 4}$$

The regression model will try to explain the observed pressure difference as a function of placement variables such as volume, rate, and density and the design choices in the job. Example of design choices are the volume or contact time of spacer, the value of standoff of the casing, the difference in densities of fluids being pumped, the difference in rheologies of fluids being pumped, the usage of mechanical separators like plug and darts, the amount of volume excess used, the difference between ECD and fracture gradient, for example. The placement variables along with design choices form factors of the model. Each of these factors will impact the surface pressure in a certain way where the impact each factor has on surface pressure can be different for different job types and locations. For example, in a location with high incidence of losses, increasing ECD can increase the risk of induced fractures and can result in lower observed surface pressure, such that Δp will reduce upon increasing ECD. In another example, increasing spacer volume can minimize contamination between cement and mud. This can result in clean interfaces between fluids and in turn increase the observed surface pressure so, Δp will increase upon increasing spacer volume. Depending on the location and job type, it is possible that some factors have more impact than others in controlling Δp. Further, it is possible that a particular factor can cause an increase in Δp for one location and a decrease in Δp for another location due to location specific attributes.

Difference between prediction from any physics-based model and actual result can be modeled using a data-driven approach with their input features. Then, the physics-based model output can be augmented with a data driven model for variance. The regression model approach can be extended to generate a data driven model for differences in a predicted cement bond log and an observed cement bond log. The dataset in block 102 can contain an output of a displacement model such as a predicted cement bond log and an observed cement bond log. The differences in observed cement bond log versus predicted cement bond log may be modeled as a function of cement placement variables, wellbore construction variable, subterranean formation properties, as well a prediction of downhole temperature and measured downhole temperature.

Figure 2:
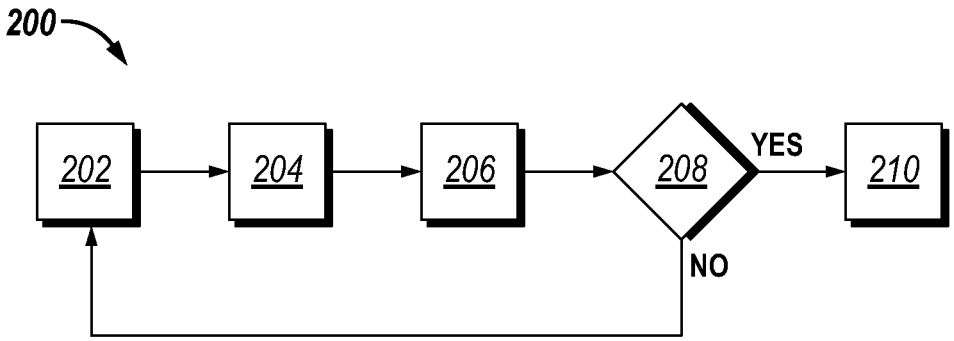
FIG. 2 illustrates a method to design a cement job using a hybrid hydraulic model, in accordance with some embodiments of the present disclosure.

FIG. 2 illustrates a process 200 to design a cement job using a hybrid hydraulic model. Process 200 begins with block 202 where cement plan data is defined. The cement plan data may include, without limitation, geographic region, wellbore job type, planned pumping rates, planned cement composition, planned spacer composition, planned fluid volumes, planned fluid densities, specifics of the construction of the well such as presence of bottom plugs, well true vertical depth (TVD), inclination, and standoff value, specifics about the subterranean formation including, but not limited to, pore pressure, fracture gradient, bottomhole static temperature, wellbore temperature profile, and flow potential factor, for example. From block 202, process 200 proceeds to block 204 where a physics-based hydraulic model, such as a hydraulic simulator, is used to calculate a planned surface pumping pressure ($P_{hydraulic}$) using the cement plan data defined in block 202. From block 204, process 200 proceeds to block 206 where a data driven hydraulic model corresponding to the geographic region and wellbore job type is selected. The selected data driven hydraulic model is then used with the cement plan data defined in block 202 to calculate pressure differential ΔP. Thereafter the observed surface pressure ($P_{observed}$) is calculated by $\Delta P = P_{observed} - P_{hydraulic}$. From block 206, process 200 proceeds to decision 208 where $P_{observed}$ is compared to a surface pressure requirement window including an upper and a lower value of surface pressure. The upper value of surface pressure requirement can be any requirements including equipment pressure limits, a surface pressure pumping goal, or any other suitable pressure limit. The lower value of surface pressure requirement can be any requirements including pore pressure of the formation. If $P_{observed}$ is not within the pressure requirement window, shown as "no" arrow in FIG. 2, process 200 proceeds back to block 202. In block 202, different cement plan data is selected. For example, a different planned pumping rate, planned cement composition, planned spacer composition, planned fluid volume, and/or planned fluid densities, or any other cement plan data, may be selected. The process may be continued until cement plan data is selected such that $P_{observed}$ is within the pressure requirement window. If $P_{observed}$ is within the pressure requirement window, shown as "yes" arrow in FIG. 2, process 200 proceeds to block 210. In block 210, the cement is prepared, and the cement job is pumped.

Cement compositions described herein may generally include a hydraulic cement and water. A variety of hydraulic cements may be utilized in accordance with the present disclosure, including, but not limited to, those comprising calcium, aluminum, silicon, oxygen, iron, and/or sulfur, which set and harden by reaction with water. Suitable hydraulic cements may include, but are not limited to, Portland cements, pozzolana cements, gypsum cements, high alumina content cements, silica cements, and any combination thereof. In certain examples, the hydraulic cement may include a Portland cement. In some examples, the Portland cements may include Portland cements that are classified as Classes A, C, H, and G cements according to American Petroleum Institute, *API Specification for Materials and Testing for Well Cements*, API Specification 10, Fifth Ed., Jul. 1, 1990. In addition, hydraulic cements may include cements classified by American Society for Testing and Materials (ASTM) in C150 (Standard Specification for Portland Cement), C595 (Standard Specification for Blended Hydraulic Cement) or C1157 (Performance Specification for Hydraulic Cements) such as those cements classified as ASTM Type I, II, or III. The hydraulic cement may be included in the cement composition in any amount suitable for a particular composition. Without limitation, the hydraulic cement may be included in the cement compositions in an amount in the range of from about 10% to about 80% by weight of dry blend in the cement composition. For example, the hydraulic cement may be present in an amount ranging between any of and/or including any of about 10%, about 15%, about 20%, about 25%, about 30%, about 35%, about 40%, about 45%, about 50%, about 55%, about 60%, about 65%, about 70%, about 75%, or about 80% by weight of the cement compositions.

The water may be from any source provided that it does not contain an excess of compounds that may undesirably affect other components in the cement compositions. For example, a cement composition may include fresh water or saltwater. Saltwater generally may include one or more dissolved salts therein and may be saturated or unsaturated as desired for a particular application. Seawater or brines may be suitable for use in some examples. Further, the water may be present in an amount sufficient to form a pumpable slurry. In certain examples, the water may be present in the cement composition in an amount in the range of from about 33% to about 200% by weight of the cementitious materials. For example, the water cement may be present in an amount ranging between any of and/or including any of about 33%, about 50%, about 75%, about 100%, about 125%, about 150%, about 175%, or about 200% by weight of the cementitious materials. The cementitious materials referenced may include all components which contribute to the compressive strength of the cement composition such as the hydraulic cement and supplementary cementitious materials, for example.

As mentioned above, the cement composition may include supplementary cementitious materials. The supplementary cementitious material may be any material that contributes to the desired properties of the cement composition. Some supplementary cementitious materials may include, without limitation, fly ash, blast furnace slag, silica fume, pozzolans, kiln dust, and clays, for example.

The cement composition may include kiln dust as a supplementary cementitious material. "Kiln dust," as that term is used herein, refers to a solid material generated as a by-product of the heating of certain materials in kilns. The term "kiln dust" as used herein is intended to include kiln dust made as described herein and equivalent forms of kiln dust. Depending on its source, kiln dust may exhibit cementitious properties in that it can set and harden in the presence of water. Examples of suitable kiln dusts include cement kiln dust, lime kiln dust, and combinations thereof. Cement kiln dust may be generated as a by-product of cement production that is removed from the gas stream and collected, for example, in a dust collector. Usually, large quantities of cement kiln dust are collected in the production of cement that are commonly disposed of as waste. The chemical analysis of the cement kiln dust from various cement manufactures varies depending on a number of factors, including the particular kiln feed, the efficiencies of the cement production operation, and the associated dust collection systems. Cement kiln dust generally may include a variety of oxides, such as $SiO_2$, $Al_2O_3$, $Fe_2O_3$, CaO, MgO, $SO_3$, $Na_2O$, and $K_2O$. The chemical analysis of lime kiln dust from various lime manufacturers varies depending on several factors, including the particular limestone or dolomitic limestone feed, the type of kiln, the mode of operation of the kiln, the efficiencies of the lime production operation, and the associated dust collection systems. Lime kiln dust generally may include varying amounts of free lime and free magnesium, lime stone, and/or dolomitic limestone and a variety of oxides, such as $SiO_2$, $Al_2O_3$, $Fe_2O_3$, CaO, MgO, $SO_3$, $Na_2O$, and $K_2O$, and other components, such as chlorides. A cement kiln dust may be added to the cement composition prior to, concurrently with, or after activation. Cement kiln dust may include a partially calcined kiln feed which is removed from the gas stream and collected in a dust collector during the manufacture of cement. The chemical analysis of CKD from various cement manufactures varies depending on a number of factors, including the particular kiln feed, the efficiencies of the cement production operation, and the associated dust collection systems. CKD generally may comprise a variety of oxides, such as $SiO_2$, $Al_2O_3$, $Fe_2O_3$, CaO, MgO, $SO_3$, $Na_2O$, and $K_2O$. The CKD and/or lime kiln dust may be included in examples of the cement composition in an amount suitable for a particular application.

In some examples, the cement composition may further include one or more of slag, natural glass, shale, amorphous silica, or metakaolin as a supplementary cementitious material. Slag is generally a granulated, blast furnace by-product from the production of cast iron including the oxidized impurities found in iron ore. The cement may further include shale. A variety of shales may be suitable, including those including silicon, aluminum, calcium, and/or magnesium. Examples of suitable shales include vitrified shale and/or calcined shale. In some examples, the cement composition may further include amorphous silica as a supplementary cementitious material. Amorphous silica is a powder that may be included in embodiments to increase cement compressive strength.

In some examples, the cement composition may further include a variety of fly ashes as a supplementary cementitious material which may include fly ash classified as Class C, Class F, or Class N fly ash according to American Petroleum Institute, API Specification for Materials and Testing for Well Cements, API Specification 10, Fifth Ed., Jul. 1, 1990. In some examples, the cement composition may further include zeolites as supplementary cementitious materials. Zeolites are generally porous alumino-silicate minerals that may be either natural or synthetic. Synthetic zeolites are based on the same type of structural cell as natural zeolites and may comprise aluminosilicate hydrates. As used herein, the term "zeolite" refers to all natural and synthetic forms of zeolite.

Where used, one or more of the aforementioned supplementary cementitious materials may be present in the cement composition. For example, without limitation, one or more supplementary cementitious materials may be present in an amount of about 0.1% to about 80% by weight of the cement composition. For example, the supplementary cementitious materials may be present in an amount ranging between any of and/or including any of about 0.10%, about 10%, about 20%, about 30%, about 40%, about 50%, about 60%, about 70%, or about 80% by weight of the cement.

In some examples, the cement composition may further include hydrated lime. As used herein, the term "hydrated lime" will be understood to mean calcium hydroxide. In some embodiments, the hydrated lime may be provided as quicklime (calcium oxide) which hydrates when mixed with water to form the hydrated lime. The hydrated lime may be included in examples of the cement composition, for example, to form a hydraulic composition with the supplementary cementitious components. For example, the hydrated lime may be included in a supplementary cementitious material-to-hydrated-lime weight ratio of about 10:1 to about 1:1 or 3:1 to about 5:1. Where present, the hydrated lime may be included in the set cement composition in an amount in the range of from about 10% to about 100% by weight of the cement composition, for example. In some examples, the hydrated lime may be present in an amount ranging between any of and/or including any of about 10%, about 20%, about 40%, about 60%, about 80%, or about 100% by weight of the cement composition. In some examples, the cementitious components present in the cement composition may consist essentially of one or more supplementary cementitious materials and the hydrated lime. For example, the cementitious components may primarily comprise the supplementary cementitious materials and the hydrated lime without any additional components (e.g., Portland cement, fly ash, slag cement) that hydraulically set in the presence of water.

Lime may be present in the cement composition in several; forms, including as calcium oxide and or calcium hydroxide or as a reaction product such as when Portland cement reacts with water. Alternatively, lime may be included in the cement composition by amount of silica in the cement composition. A cement composition may be designed to have a target lime to silica weight ratio. The target lime to silica ratio may be a molar ratio, molal ratio, or any other equivalent way of expressing a relative amount of silica to lime. Any suitable target time to silica weight ratio may be selected including from about 10/90 lime to silica by weight to about 40/60 lime to silica by weight. Alternatively, about 10/90 lime to silica by weight to about 20/80 lime to silica by weight, about 20/80 lime to silica by weight to about 30/70 lime to silica by weight, or about 30/70 lime to silica by weight to about 40/63 lime to silica by weight.

Other additives suitable for use in subterranean cementing operations also may be included in embodiments of the cement composition. Examples of such additives include, but are not limited to: weighting agents, lightweight additives, gas-generating additives, mechanical-property-enhancing additives, lost-circulation materials, filtration-control additives, fluid-loss-control additives, defoaming agents, foaming agents, thixotropic additives, and combinations thereof. In embodiments, one or more of these additives may be added to the cement composition after storing but prior to the placement of a cement composition into a subterranean formation. In some examples, the cement composition may further include a dispersant. Examples of suitable dispersants include, without limitation, sulfonated-formaldehyde-based dispersants (e.g., sulfonated acetone formaldehyde condensate) or polycarboxylated ether dispersants. In some examples, the dispersant may be included in the cement composition in an amount in the range of from about 0.01% to about 5% by weight of the cementitious materials. In specific examples, the dispersant may be present in an amount ranging between any of and/or including any of about 0.01%, about 0.1%, about 0.5%, about 1%, about 2%, about 3%, about 4%, or about 5% by weight of the cementitious materials.

In some examples, the cement composition may further include a set retarder. A broad variety of set retarders may be suitable for use in the cement compositions. For example, the set retarder may comprise phosphonic acids, such as ethylenediamine tetra(methylene phosphonic acid), diethylenetriamine penta(methylene phosphonic acid), etc.; lignosulfonates, such as sodium lignosulfonate, calcium lignosulfonate, etc.; salts such as stannous sulfate, lead acetate, monobasic calcium phosphate, organic acids, such as citric acid, tartaric acid, etc.; cellulose derivatives such as hydroxyl ethyl cellulose (HEC) and carboxymethyl hydroxyethyl cellulose (CMHEC); synthetic co- or ter-polymers comprising sulfonate and carboxylic acid groups such as sulfonate-functionalized acrylamide-acrylic acid copolymers; borate compounds such as alkali borates, sodium metaborate, sodium tetraborate, potassium pentaborate; derivatives thereof, or mixtures thereof. Examples of suitable set retarders include, among others, phosphonic acid derivatives. Generally, the set retarder may be present in the cement composition in an amount sufficient to delay the setting for a desired time. In some examples, the set retarder may be present in the cement composition in an amount in the range of from about 0.010% to about 10% by weight of the cementitious materials. In specific examples, the set retarder may be present in an amount ranging between any of and/or including any of about 0.01%, about 0.1%, about 1%, about 2%, about 4%, about 6%, about 8%, or about 10% by weight of the cementitious materials.

In some examples, the cement composition may further include an accelerator. A broad variety of accelerators may be suitable for use in the cement compositions. For example, the accelerator may include, but are not limited to, aluminum sulfate, alums, calcium chloride, calcium nitrate, calcium nitrite, calcium formate, calcium sulphoaluminate, calcium sulfate, gypsum-hemihydrate, sodium aluminate, sodium carbonate, sodium chloride, sodium silicate, sodium sulfate, ferric chloride, or a combination thereof. In some examples, the accelerators may be present in the cement composition in an amount in the range of from about 0.01% to about 10% by weight of the cementitious materials. In specific examples, the accelerators may be present in an amount ranging between any of and/or including any of about 0.01%, about 0.1%, about 1%, about 2%, about 4%, about 6%, about 8%, or about 10% by weight of the cementitious materials.

Cement compositions generally should have a density suitable for a particular application. By way of example, the cement composition may have a density in the range of from about 8 pounds per gallon ("ppg") (959 kg/m$^3$) to about 20 ppg (2397 kg/m$^3$), or about 8 ppg to about 12 ppg (1437. kg/m$^3$), or about 12 ppg to about 16 ppg (1917.22 kg/m$^3$), or about 16 ppg to about 20 ppg, or any ranges therebetween. Examples of the cement compositions may be foamed or unfoamed or may comprise other means to reduce their densities, such as hollow microspheres, low-density elastic beads, or other density-reducing additives known in the art.

The cement slurries disclosed herein may be used in a variety of subterranean applications, including primary and remedial cementing. The cement slurries may be introduced into a subterranean formation and allowed to set. In primary cementing applications, for example, the cement slurries may be introduced into the annular space between a conduit located in a wellbore and the walls of the wellbore (and/or a larger conduit in the wellbore), wherein the wellbore penetrates the subterranean formation. The cement slurry may be allowed to set in the annular space to form an annular sheath of hardened cement. The cement slurry may form a barrier that prevents the migration of fluids in the wellbore. The cement composition may also, for example, support the conduit in the wellbore. In remedial cementing applications, the cement compositions may be used, for example, in squeeze cementing operations or in the placement of cement plugs. By way of example, the cement compositions may be placed in a wellbore to plug an opening (e.g., a void or crack) in the formation, in a gravel pack, in the conduit, in the cement sheath, and/or between the cement sheath and the conduit (e.g., a micro annulus).

Figure 3:
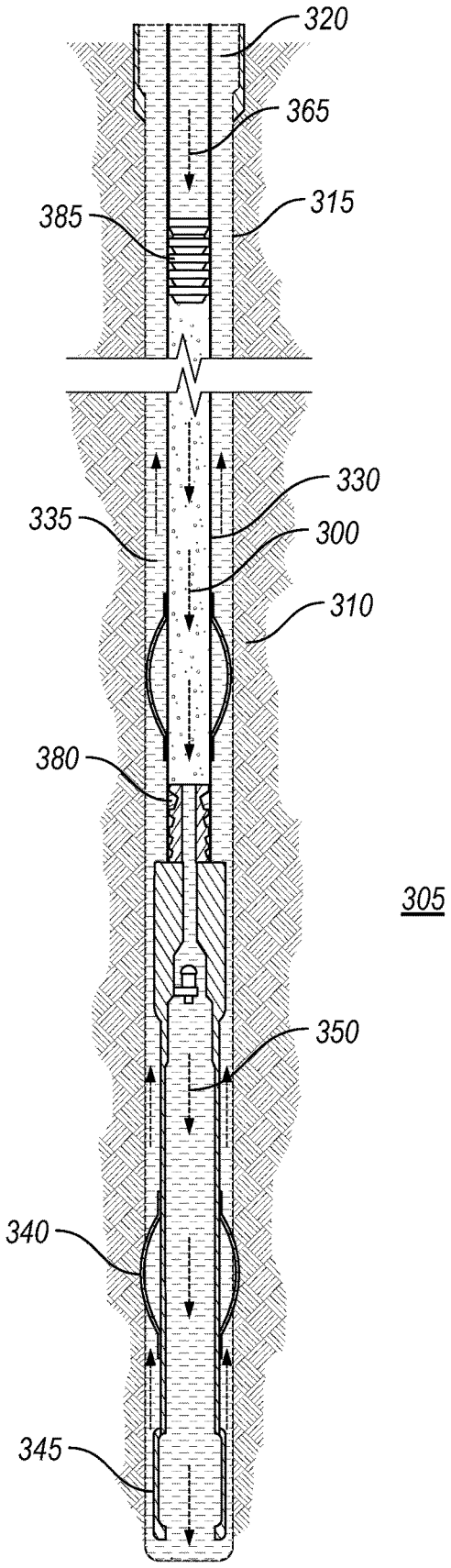
FIG. 3 is a schematic illustration of introduction of a cement slurry into a wellbore, in accordance with some embodiments of the present disclosure.

Reference is now made to FIG. 3, illustrating use of a cement slurry 300. Cement slurry 300 may comprise any of the components described herein and may be designed using a hybrid model as described above. Cement slurry 300 may be placed into a subterranean formation 305 in accordance with example systems, methods and cement slurries. The subterranean formation 305 may a reservoir for oil, gas, and water or may be a depleted formation. In embodiments the subterranean formation 305 is used for carbon capture underground storage. As illustrated, a wellbore 310 may be drilled into the subterranean formation 305. While wellbore 310 is shown extending generally vertically into the subterranean formation 305, the principles described herein are also applicable to wellbores that extend at an angle through the subterranean formation 305, such as horizontal and slanted wellbores. As illustrated, the wellbore 310 comprises walls 315. In the illustration, casing 330 may be cemented to the walls 315 of the wellbore 310 by cement sheath 320. In the illustration, one or more additional conduits (e.g., intermediate casing, production casing, liners, etc.), shown here as casing 330 may also be disposed in the wellbore 310. As illustrated, there is a wellbore annulus 335 formed between the casing 330 and the walls 315 of the wellbore 310. One or more centralizers 340 may be attached to the casing 330, for example, to centralize the casing 330 in the wellbore 310 prior to and during the cementing operation. The cement slurry 300 may be pumped down the interior of the casing 330. The cement slurry 300 may be allowed to flow down the interior of the casing 330 through the casing shoe 345 at the bottom of the casing 330 and up around the casing 330 into the wellbore annulus 335. The cement slurry 300 may be allowed to set in the wellbore annulus 335, for example, to form a cement sheath that supports and positions the casing 330 in the wellbore 310. While not illustrated, other techniques may also be utilized for introduction of the cement slurry 300. By way of example, reverse circulation techniques may be used that include introducing the cement slurry 300 into the subterranean formation 305 by way of the wellbore annulus 335 instead of through the casing 330. As it is introduced, the cement slurry 300 may displace other fluids 350, such as drilling fluids and/or spacer fluids that may be present in the interior of the casing 330 and/or the wellbore annulus 335. While not illustrated, at least a portion of the displaced fluids 350 may exit the wellbore annulus 335 via a flow line and be deposited, for example, in one or more retention pits. A bottom plug 355 may be introduced into the wellbore 310 ahead of the cement slurry 300, for example, to separate the cement slurry 300 from the fluids 350 that may be inside the casing 330 prior to cementing. After the bottom plug 355 reaches the landing collar 380, a diaphragm or other suitable device should rupture to allow the cement slurry 300 through the bottom plug 355. The bottom plug 355 is shown on the landing collar 380. In the illustration, a top plug 385 may be introduced into the wellbore 310 behind the cement slurry 300. The top plug 360 may separate the cement slurry 300 from a displacement fluid 365 and also push the cement slurry 300 through the bottom plug 355.

The following statements may describe certain embodiments of the disclosure but should be read to be limiting to any particular embodiment.

Statement 1. A method of designing a cement job comprising: (a) selecting a cement job plan comprising: cement placement variables, wellbore construction variables, and subterranean formation properties; (b) calculating a predicted hydraulic pressure ($P_{hydraulic}$) of the cement job plan using a physics based hydraulic model; (c) calculating a pressure differential ($\Delta P$) of the cement job plan using a data driven hydraulic model; (d) calculating a predicted observed surface pressure ($P_{observed}$) from the pressure differential ($\Delta P$) and a predicted hydraulic pressure ($P_{hydraulic}$); (e) comparing the predicted observed surface pressure ($P_{observed}$) to a surface pressure requirement window, wherein steps (a)-(e) are repeated if the predicted observed surface pressure ($P_{observed}$) is outside the surface pressure requirement window, wherein each repeated step of selecting comprises selecting at least one different cement placement variable or wellbore construction variable than previously selected, or step (f) is performed if the predicted observed surface pressure ($P_{observed}$) is within the surface pressure requirement window; and (f) performing a cementing operation in a subterranean formation according to the cement job plan.

Statement 2. The method of statement 1 wherein the cement placement variables comprise at least one variable selected from the group consisting of planned surface pumping pressures, planned pumping rates, planned cement composition, planned spacer composition, planned fluid volumes, planned fluid densities, and combinations thereof.

Statement 3. The method of any of statements 1-2 wherein the wellbore construction variable comprise at least one variable selected from the group consisting of presence of bottom plugs, well true vertical depth (TVD), well true measured depth (TMD), inclination, and standoff value, dog leg severity, and combinations thereof.

Statement 4. The method of any of statements 1-3 wherein the subterranean formation properties comprise at least one property selected from the group consisting of pore pressure, fracture gradient, bottomhole static temperature, wellbore temperature profile, flow potential factor, and combinations thereof.

Statement 5. The method of any of statements 1-4 wherein the physics based hydraulic model comprises a computational fluid dynamics (CFD) model.

Statement 6. The method of any of statements 1-5 wherein the data driven hydraulic model is specific to a geographic region and a wellbore cementing job type in the geographic region.

Statement 7. The method of statement 6 wherein the cementing job type is at least one job selected from the group consisting of cementing a surface casing, cementing a conductor casing, cementing an intermediate casing, cementing a production casing, cementing a production liner, and combinations thereof.

Statement 8. The method of any of statements 1-7 wherein the data driven hydraulic model comprises a regression model of observed pressure differential modeled as a function of cement placement variables, wellbore construction variables, and subterranean formation properties.

Statement 9. The method of statement 8 wherein the regression model has the form of multilinear, parabolic, exponential, derivative, integral, hyperbolic, trigonometric, or combinations thereof.

Statement 10. The method of any of statements 8-9 wherein the regression model includes a model factor selected from the group consisting of bottom plugs, flow rate difference of actual versus design, volume difference of actual versus design, spacer contact time, volume excess, well true vertical depth, flow potential factor, maximum equivalent circulating density versus fracture gradient, density difference of actual versus design, inclination, minimum hydrostatic pressure vs pore pressure, minimum density between successive fluid trains, standoff value, and combinations thereof.

Statement 11. The method of any of statements 1-10 wherein selecting at least one different cement placement variables than previously selected comprises selecting a different planned pumping rate, a different planned cement composition, a different planned spacer composition, a different planned fluid volume, a different planned fluid density, or a combination thereof.

Statement 12. The method of any of statements 1-11 further comprising selecting at least one different wellbore construction variable in step (e), the at least one different construction variable comprising at least one variable selected from the group consisting of presence of bottom plugs, well true vertical depth (TVD), well true measured depth (TMD), inclination, and standoff value, dog leg severity, and combinations thereof.

Statement 13. The method of any of statements 1-12 further comprising selecting at least one different subterranean formation property in step (e), the at least one different construction variable comprising at least one property selected from the group consisting of pore pressure, fracture gradient, bottomhole static temperature, wellbore temperature profile, flow potential factor, and combinations thereof.

Statement 14. A method comprising: extracting planned cement job data and completed cement job data from a dataset of cement job data, wherein the planned cement job data and the completed cement job data correspond to one geographic region and one type of wellbore cementing job type in the geographic region, wherein the planned cement job data comprises at least planned surface pumping pressures, planned pumping volumes, planned pumping rates, and planned fluid densities, and wherein the completed cement job data comprises at least observed surface pumping pressures, observed pumping volumes, observed pumping rates, and observed fluid densities; correlating, using a regression model, an observed pressure differential $\Delta P$, to all differences between the planned cement job data and the completed cement job data to generate a data driven hydraulic model; calculating a predicted hydraulic pressure ($P_{hydraulic}$) of a proposed cement job plan using a physics based hydraulic model, wherein the proposed cement job plan comprises at least proposed surface pumping pressures, proposed pumping volumes, proposed pumping rates, and proposed fluid densities; calculating a pressure differential (ΔP) of the proposed cement job using the data driven hydraulic model; calculating a predicted observed surface pressure ($P_{predicted}$) from the pressure differential (ΔP) and the predicted hydraulic pressure ($P_{hydraulic}$); comparing the predicted observed surface pressure ($P_{predicted}$) to a surface pressure requirement window and modifying at least one of the proposed surface pumping pressures, the proposed pumping volumes, the proposed pumping rates, and/or the proposed fluid densities in response to the comparison; and performing a cementing operation in a subterranean formation according to the proposed cement job plan.

Statement 15. The method of statement 14 wherein the planned cement job data and the completed cement job data further comprises cement placement variables selected from the group consisting of planned pumping rate, a different planned cement composition, a different planned spacer composition, a different planned fluid volume, a different planned fluid density, or a combination thereof.

Statement 16. The method of any of statements 14-15 wherein the planned cement job data and the completed cement job data further comprises wellbore construction variables selected from the group consisting of presence of bottom plugs, well true vertical depth (TVD), well true measured depth (TMD), inclination, and standoff value, dog leg severity, and combinations thereof.

Statement 17. The method of any of statements 14-16 wherein the planned cement job data and the completed cement job data further comprises subterranean formation properties selected from the group consisting of pore pressure, fracture gradient, bottomhole static temperature, wellbore temperature profile, flow potential factor, and combinations thereof.

Statement 18. The method of any of statements 14-17 wherein the data driven hydraulic model comprises a regression model of observed pressure differential modeled as a function of cement placement variables, wellbore construction variables, and subterranean formation properties.

Statement 19. The method of any of statements 14-18 wherein the regression model has the form of multilinear, parabolic, exponential, derivative, integral, hyperbolic, trigonometric, or combinations thereof.

Statement 20. The method of any of statements 14-19 wherein the regression model includes a model factor selected from the group consisting of bottom plugs, flow rate difference of actual versus design, volume difference of actual versus design, spacer contact time, volume excess, well true vertical depth, flow potential factor, maximum equivalent circulating density versus fracture gradient, density difference of actual versus design, inclination, minimum hydrostatic pressure vs pore pressure, minimum density between successive fluid trains, standoff value, and combinations thereof.

Example

In this example, a data driven hydraulic model was constructed as described above using a dataset of executed wellbore cementing jobs in various geographical locations and various job types including cementing surface casings, cementing conductor casings, cementing intermediate casings, cementing production casings, and cementing production liners. The dataset contained job design cement placement variables such as planned pumping pressures, rates, volumes, and densities. The dataset further contained observed cement placement variables for each cement job including observed surface pressure pumping pressures, observed rates, observed volumes, and observed fluid densities, wellbore characteristics and construction, and telemetry collected during cement placement.

The difference (ΔP) in end of job was modeled using multiple linear regression as a function of all factors in the dataset for each geographical location and job type. The output of the regression modeling was the data driven hydraulic model.

Figure 4:
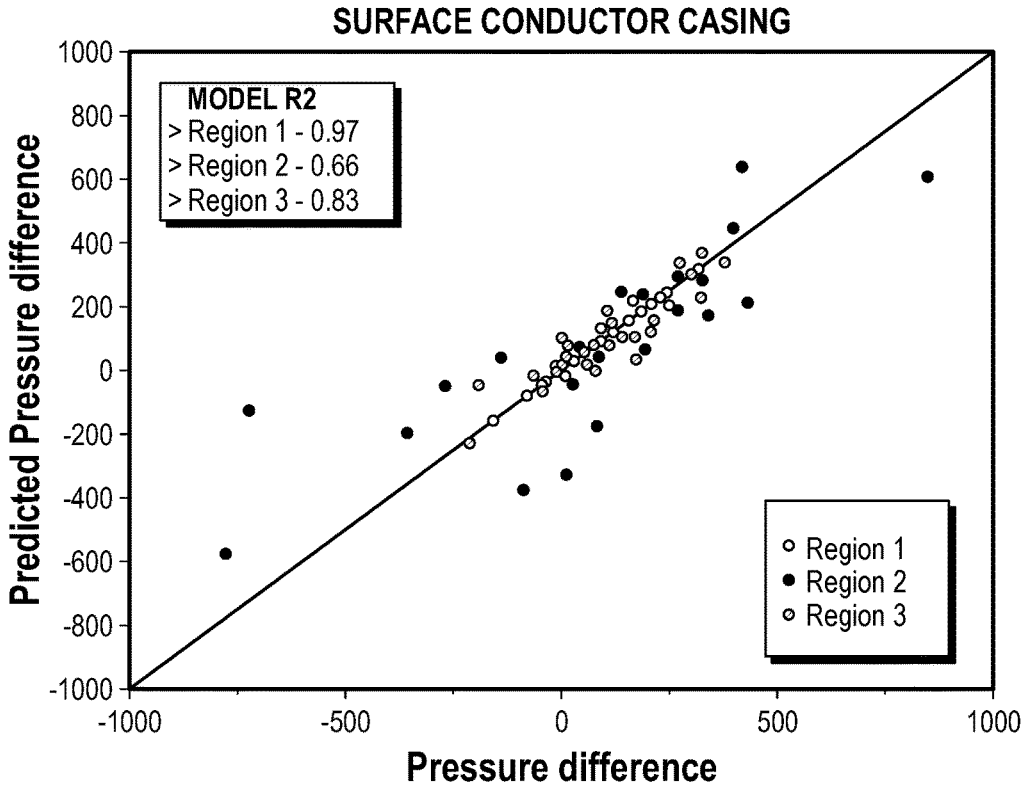
FIG. 4 is a parity plot of observed pressure difference and predicted pressure difference from a data driven hydraulic model, in accordance with some embodiments of the present disclosure.
Figure 5:
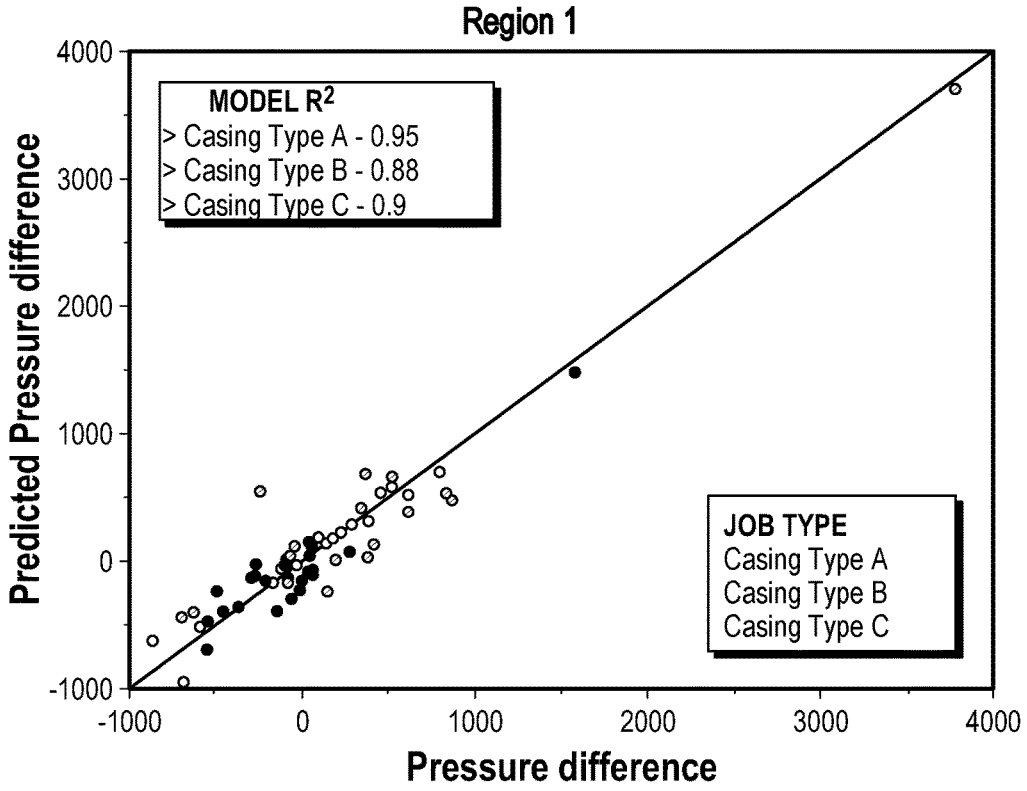
FIG. 5 is a parity plot of observed pressure difference and predicted pressure difference from a hydraulic data driven model, in accordance with some embodiments of the present disclosure.

A predicted pressure difference was calculated for a set of cementing jobs using a data driven hydraulic model corresponding to region and cementing job type. The predicted pressure was compared to the observed pressure. FIG. 4 is a parity plot of observed pressure difference and predicted pressure difference (ΔP) for 3 regions. It was observed that the model coefficient of determination was 0.97 for region 1, 0.66 for region 2, and 0.83 for region 3. FIG. 5 is a parity plot of observed pressure difference and predicted pressure difference for cementing three different casing types in region 1. It was observed that the coefficient of determination was 0.95 for cementing casing type A, 0.88 for cementing casing type B, and 0.9 for cementing casing type C.

A significant factor analysis was performed for each of the data driven hydraulic models generated above. It was observed that some factors have a significant impact on surface pumping pressure in some locations and job types but not in other regions/locations and job types. Table 1 is a chart showing a list of design choices and whether the design choice has a significant impact on surface pumping pressure according to the data driven hydraulic models generated.

TABLE 1

| Design Choice (Factors) | Region 3 Location 1 Casing Type B | Region 3 Location 1 Casing Type A | Region 1 Location 1 Casing Type A | Region 3 Location 2 Casing Type B | Region 3 Location 2 Casing Type C |
|---|---|---|---|---|---|
| No Bottom plugs | Y | | Y | Y | Y |
| Flow rate difference (actual vs. design) | Y | | | Y | Y |
| Volume difference (actual vs. design) | Y | Y | | Y | Y |
| Spacer Contact Time | | | Y | | |
| Volume excess | Y | | | Y | Y |
| Well TVD | Y | Y | Y | Y | |
| Flow Potential Factor | Y | | Y | | Y |
| Maximum ECD vs. Fracture Gradient | Y | Y | Y | Y | |
| Density difference (actual vs. design) | | Y | | Y | Y |
| Inclination | Y | | | | |
| Minimum Hydrostatic Pressure vs Pore Pressure | Y | Y | | | |
| Minimum density difference between two successive fluid trains | Y | Y | | | |
| Standoff value | | Y | Y | Y | |

The disclosed cement compositions and associated methods may directly or indirectly affect any pumping systems, which representatively includes any conduits, pipelines, trucks, tubulars, and/or pipes which may be coupled to the pump and/or any pumping systems and may be used to fluidically convey the cement compositions downhole, any pumps, compressors, or motors (e.g., topside or downhole) used to drive the cement compositions into motion, any valves or related joints used to regulate the pressure or flow rate of the cement compositions, and any sensors (i.e., pressure, temperature, flow rate, etc.), gauges, and/or combinations thereof, and the like. The cement compositions may also directly or indirectly affect any mixing hoppers and retention pits and their assorted variations.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present disclosure is well adapted to attain the ends and advantages mentioned as well as those that are inherent therein. The particular examples disclosed above are illustrative only, as the present disclosure may be modified and practiced in different but equivalent manners apparent to those skilled in the art having the benefit of the teachings herein. Although individual examples are discussed, the disclosure covers all combinations of all those examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

What is claimed is:

1. A method of designing a cement job comprising:

(a) selecting a cement job plan comprising: cement placement variables, wellbore construction variables, and subterranean formation properties, wherein at least one of the cement placement variables, wellbore construction variables, or subterranean formation properties is location, rig, or pad specific, and wherein each of the variables impacts surface pressure;

(b) calculating a predicted hydraulic pressure (Phydraulic) of the cement job plan using a physics based hydraulic model;

(c) generating a data driven hydraulic model that models pressure difference as a function of the one or more location, rig, or pad specific variables;

(d) calculating a pressure differential ($\Delta P$) of the cement job plan using the data driven hydraulic model;

(e) calculating a predicted observed surface pressure (Pobserved) from the pressure differential ($\Delta P$) and a predicted hydraulic pressure (Phydraulic);

(f) comparing the predicted observed surface pressure (Pobserved) to a surface pressure requirement window, wherein steps (a)-(e) are repeated if the predicted observed surface pressure (Pobserved) is outside the surface pressure requirement window, wherein each repeated step of selecting comprises selecting at least one different cement placement variable or wellbore construction variable than previously selected, (g) generating a cement job plan that satisfies the desired surface pressure requirement window, wherein the cement job plan comprises a planned cementing fluid pumping rate, a planned cementing fluid composition, a planned cementing fluid density, and a planned cementing fluid volume; and (h) performing a cementing operation in a subterranean formation based on the cement job plan by introducing a cementing fluid into the subterranean formation such that an observed surface pressure is within the surface pressure requirement window of the cement job plan, wherein performing the cement operation comprises pumping using a pumping system, the cementing fluid at the planned cementing fluid pumping rate, the planned cementing fluid composition, the planned cementing fluid density, and the planned cementing fluid volume.

2. The method of claim 1 wherein the cement placement variables comprise at least one variable selected from the group consisting of planned surface pumping pressures, planned pumping rates, planned cement composition, planned spacer composition, planned fluid volumes, planned fluid densities, and combinations thereof.

3. The method of claim 1 wherein the wellbore construction variables comprise at least one variable selected from the group consisting of presence of bottom plugs, well true vertical depth (TVD), well true measured depth (TMD), inclination, and standoff value, dog leg severity, and combinations thereof.

4. The method of claim 1 wherein the subterranean formation properties comprise at least one property selected from the group consisting of pore pressure, fracture gradient, bottomhole static temperature, wellbore temperature profile, flow potential factor, and combinations thereof.

5. The method of claim 1 wherein the physics based hydraulic model comprises a computational fluid dynamics (CFD) model.

6. The method of claim 1 wherein the data driven hydraulic model is specific to a geographic region and a wellbore cementing job type in the geographic region.

7. The method of claim 6 wherein the cementing job type is at least one job selected from the group consisting of cementing a surface casing, cementing a conductor casing, cementing an intermediate casing, cementing a production casing, cementing a production liner, and combinations thereof.

8. The method of claim 1 wherein the data driven hydraulic model comprises a regression model of observed pressure differential modeled as a function of cement placement variables, wellbore construction variables, and subterranean formation properties.

9. The method of claim 8 wherein the regression model has the form of multilinear, parabolic, exponential, derivative, integral, hyperbolic, trigonometric, or combinations thereof.

10. The method of claim 8 wherein the regression model includes a model factor selected from the group consisting of bottom plugs, flow rate difference of actual versus design, volume difference of actual versus design, spacer contact time, volume excess, well true vertical depth, flow potential factor, maximum equivalent circulating density versus fracture gradient, density difference of actual versus design, inclination, minimum hydrostatic pressure vs pore pressure, minimum density between successive fluid trains, standoff value, and combinations thereof.

11. The method of claim 1 wherein selecting at least one different cement placement variable than previously selected comprises selecting a different planned pumping rate, a different planned cement composition, a different planned spacer composition, a different planned fluid volume, a different planned fluid density, or a combination thereof.

12. The method of claim 1 further comprising selecting at least one different wellbore construction variable in step (e), the at least one different construction variable comprising at least one variable selected from the group consisting of presence of bottom plugs, well true vertical depth (TVD), well true measured depth (TMD), inclination, and standoff value, dog leg severity, and combinations thereof.

13. The method of claim 1 further comprising selecting at least one different subterranean formation property in step (e), the at least one different construction variable comprising at least one property selected from the group consisting of pore pressure, fracture gradient, bottomhole static temperature, wellbore temperature profile, flow potential factor, and combinations thereof.

14. A method comprising:

extracting planned cement job data and completed cement job data from a dataset of cement job data, wherein the planned cement job data and the completed cement job data correspond to one geographic region and one type of wellbore cementing job type in the geographic region, wherein the planned cement job data comprises at least planned surface pumping pressures, planned pumping volumes, planned pumping rates, and planned fluid densities, and wherein the completed cement job data comprises at least observed surface pumping pressures, observed pumping volumes, observed pumping rates, and observed fluid densities, wherein one or more of the planned cement job data is location, rig or pad specific, and wherein each of the datum impacts surface pressure;

correlating, using a regression model, an observed pressure differential ΔP, to all differences between the planned cement job data and the completed cement job data to generate a data driven hydraulic model that models pressure difference as a function of one or more location, rig, or pad specific variables;

calculating a predicted hydraulic pressure (Phydraulic) of a proposed cement job plan using a physics based hydraulic model, wherein the proposed cement job plan comprises at least proposed surface pumping pressures, proposed pumping volumes, proposed pumping rates, and proposed fluid densities;

calculating a pressure differential (ΔP) of the proposed cement job using the data driven hydraulic model that models pressure difference as a function of the one or more location, rig, or pad specific variables;

calculating a predicted observed surface pressure (Ppredicted) from the pressure differential (ΔP) and the predicted hydraulic pressure (Phydraulic);

comparing the predicted observed surface pressure (Ppredicted) to a surface pressure requirement window and modifying at least one of the proposed surface pumping pressures, the proposed pumping volumes, the proposed pumping rates, and/or the proposed fluid densities in response to the comparison;

generating a final cement job plan that satisfies the surface pressure requirement window, wherein the final cement job plan comprises a planned cementing fluid pumping rate a planned cementing fluid composition, a planned cementing fluid density, and a planned cementing fluid volume; and performing a cementing operation in a subterranean formation based on the proposed cement job plan by introducing a cementing fluid into the subterranean formation such that an observed surface pressure is within the surface pressure requirement window of the final cement job plan, wherein performing the cement operation comprises pumping, using a pumping system, the cementing fluid at the planned cementing fluid pumping rate, the planned cementing fluid composition, the planned cementing fluid density, and the planned cementing fluid volume.

15. The method of claim 14 wherein the planned cement job data and the completed cement job data further comprises cement placement variables selected from the group consisting of planned pumping rate, a different planned cement composition, a different planned spacer composition, a different planned fluid volume, a different planned fluid density, or a combination thereof.

16. The method of claim 14 wherein the planned cement job data and the completed cement job data further comprises wellbore construction variables selected from the group consisting of presence of bottom plugs, well true vertical depth (TVD), well true measured depth (TMD), inclination, and standoff value, dog leg severity, and combinations thereof.

17. The method of claim 14 wherein the planned cement job data and the completed cement job data further comprises subterranean formation properties selected from the group consisting of pore pressure, fracture gradient, bottomhole static temperature, wellbore temperature profile, flow potential factor, and combinations thereof.

18. The method of claim 14 wherein the data driven hydraulic model comprises a regression model of observed pressure differential modeled as a function of cement placement variables, wellbore construction variables, and subterranean formation properties.

19. The method of claim 18 wherein the regression model has the form of multilinear, parabolic, exponential, derivative, integral, hyperbolic, trigonometric, or combinations thereof.

20. The method of claim 18 wherein the regression model includes a model factor selected from the group consisting of bottom plugs, flow rate difference of actual versus design, volume difference of actual versus design, spacer contact time, volume excess, well true vertical depth, flow potential factor, maximum equivalent circulating density versus fracture gradient, density difference of actual versus design, inclination, minimum hydrostatic pressure vs pore pressure, minimum density between successive fluid trains, standoff value, and combinations thereof.

* * * * *